United States Patent [19]

Okada et al.

[11] 4,435,134

[45] Mar. 6, 1984

[54] FLOW CONTROL VALVE

[76] Inventors: Akio Okada, 11-19, Tsudanuma 2-chome, Narashino-shi, Chiba-ken; Tokifumi Nakata, 14-8, Nishitsuga 3-chome, Chiba-shi, Chiba-ken; Kiyoshi Nemoto, 2290-2, Kikuma, Ichihara-shi, Chiba-ken, all of Japan

[21] Appl. No.: 390,833

[22] Filed: Jun. 22, 1982

[51] Int. Cl.[3] ..... F04B 23/06; F04B 41/06

[52] U.S. Cl. ..... 417/428; 417/440; 137/607

[58] Field of Search ..... 137/607; 417/288, 304, 417/428, 440

[56] References Cited

U.S. PATENT DOCUMENTS

| | | | |
|---|---|---|---|
| 2,420,052 | 5/1947 | Muir | 417/428 |
| 2,758,543 | 12/1951 | Harr | 137/607 X |
| 4,277,031 | 7/1981 | Moumaneix et al. | 137/607 X |

FOREIGN PATENT DOCUMENTS

| | | | |
|---|---|---|---|
| 347148 | 7/1960 | Switzerland | 137/607 |
| 611064 | 5/1978 | U.S.S.R. | 137/607 |

*Primary Examiner*—Richard E. Gluck

*Attorney, Agent, or Firm*—Toren, McGeady and Stanger

[57] ABSTRACT

A discharge flow control rate valve for a multiple cylinder type reciprocating pump has a flow rate control valve associated with two cylinders of the pump. The flow control valve has a bypass passage connecting the suction side of the pump with a stepped cylinder chamber provided in the body member of the control valve. A needle valve fitted with a separate valving element is reciprocably disposed in the stepped cylinder chamber and operates to return a part of the fluid in the first cylinder or in the first and second cylinders to the suction side of the pump as a function of the intrusion distance of the valve into the cylinder chamber so as to modify the overall discharge flow rate of the pump.

5 Claims, 4 Drawing Figures

FLOW CONTROL VALVE

FIELD OF THE INVENTION

This invention relates to a discharge flow rate control valve in a multiple cylinder type reciprocating pump used for instance for supplying the boiler feed water or in conjunction with hydraulic machines wherein the working fluid is subjected to a rather elevated pressure.

The discharge flow rate control valve of the present invention makes it possible to simultaneously adjust the flow and pressure in plural cylinders of the pump without regard to the operation of the discharge valves for modifying the overall discharge flow rate of the pump.

Heretofore, when the multiple cylinder reciprocating pump of this kind is employed for supplying the feed water to a boiler, both the cold water and warm water may be obtained by suitably adjusting the water temperature. However, when desired to produce steam besides cold and warm water, it is necessary to use a special device for that purpose. In addition, some safety measures must be resorted to when steam is to be produced by high pressure injection with resulting complex overall structure and necessity for special maintenance and services.

SUMMARY OF THE INVENTION

In consideration of the conventional practice as defined above, the present invention envisages to provide a flow rate control valve for a multiple cylinder type reciprocating pump wherein the valve is mounted on the discharge side of the pump and operable to simultaneously control the flow rate and pressure of the fluid in two cylinders of the pump to present valves for controlling the overall pump discharge as desired. It is also possible for only one pump to yield cold water, warm water and steam through suitable control of the water temperature.

DESCRIPTION OF A PREFERRED EMBODIMENT

Reference is now made to the accompanying drawings for illustration of a preferred embodiment of the present invention.

Figure 1:
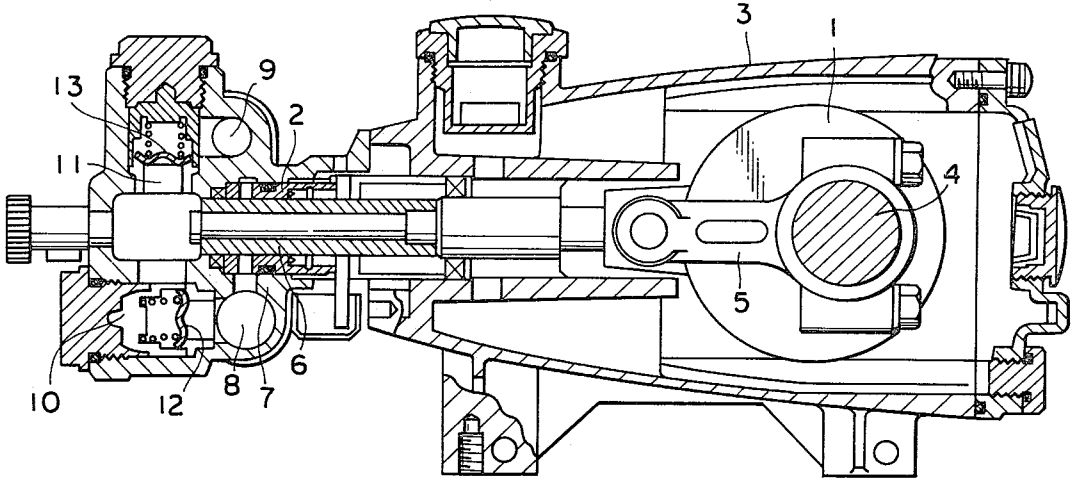
FIG. 1 is a longitudinal section showing a fluid control valve of the present invention as applied to a multiple cylinder type reciprocating pump.

FIG. 1 shows the flow rate control valve of the invention as applied to a triple cylinder type reciprocating pump 3 having a driving portion 1 and a pump portion 2. A crankshaft 4 connected to a drive source, not shown, is rotatably mounted in the driving portion 1. To this crankshaft 4 are connected three juxtaposed pistons 6 by way of respective crank arms 5 operatively associated with the crankshaft 4, these pistons 6 extending into the pump portion 2 and slidably disposed within three juxtaposed cylinders 7 in the pump portion 2. Although each one of the crank arms 5, pistons 6 and cylinders 7 is shown in the sectional side elevation of FIG. 1, it should be understood that the respective three members 5, 6, 7 are juxtaposed parallel to each other in the pump section and are operatively connected to the sole crankshaft 4.

The cylinder bore of each cylinder 7 communicates with a suction port 8 and a discharge port 9 and has inlet and outlet ducts 10, 11 in which suction and discharge valves 12, 13 are mounted respectively as shown in FIG. 1. The fluid is introduced through suction port 8 with reciprocating motion of the pistons 6 and discharged through discharge ports 9 by way of suction valve 12 and discharge valve 13 to a boiler or similar device, not shown.

Figure 2:
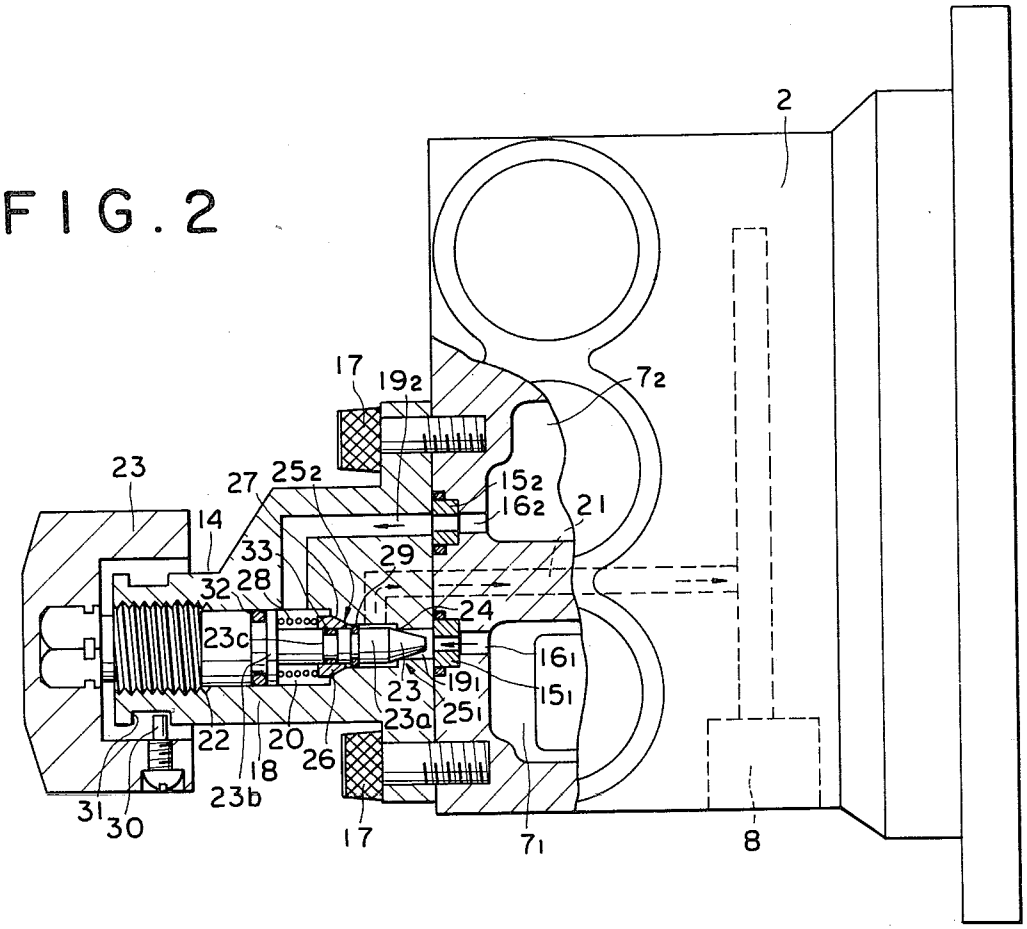
FIG. 2 is a plan view of the same with parts thereof shown in transverse section.
Figure 3:
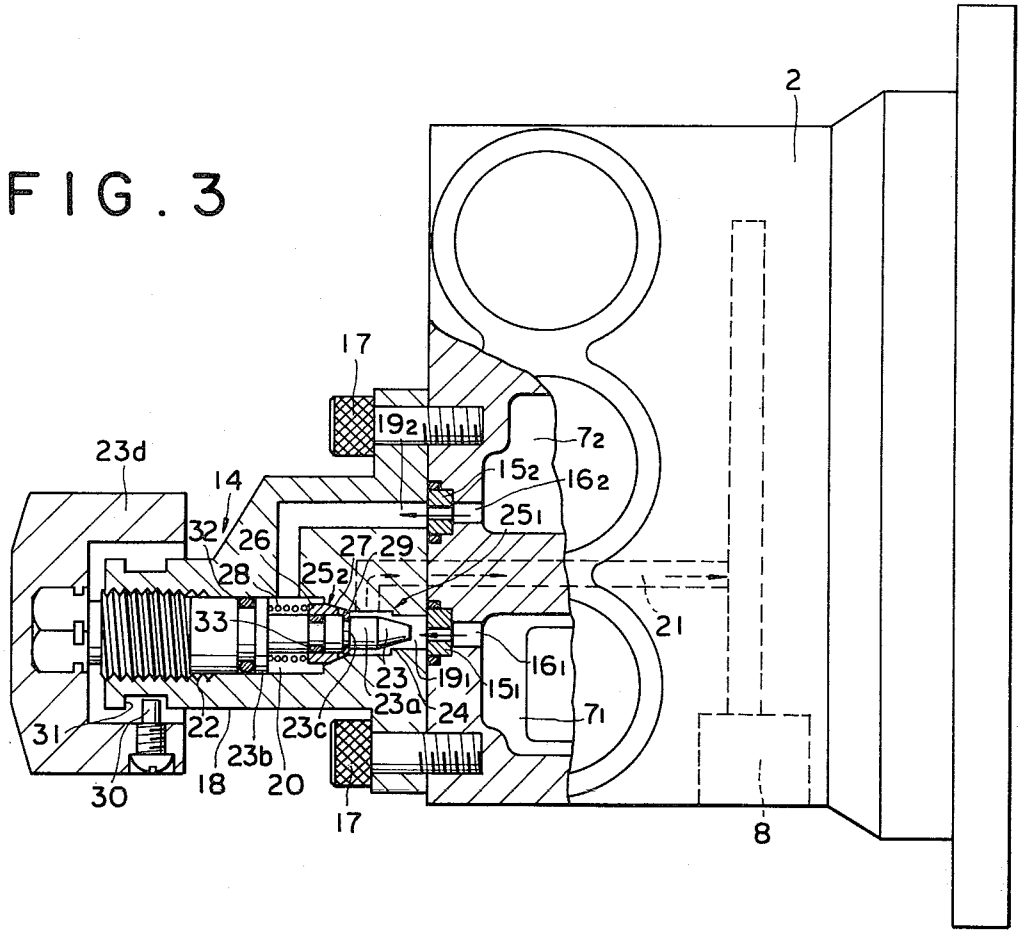
FIGS. 3 and 4 are the views similar to FIG. 2, and showing the fluid control valve in different operational states than those shown in FIG. 2.
Figure 4:
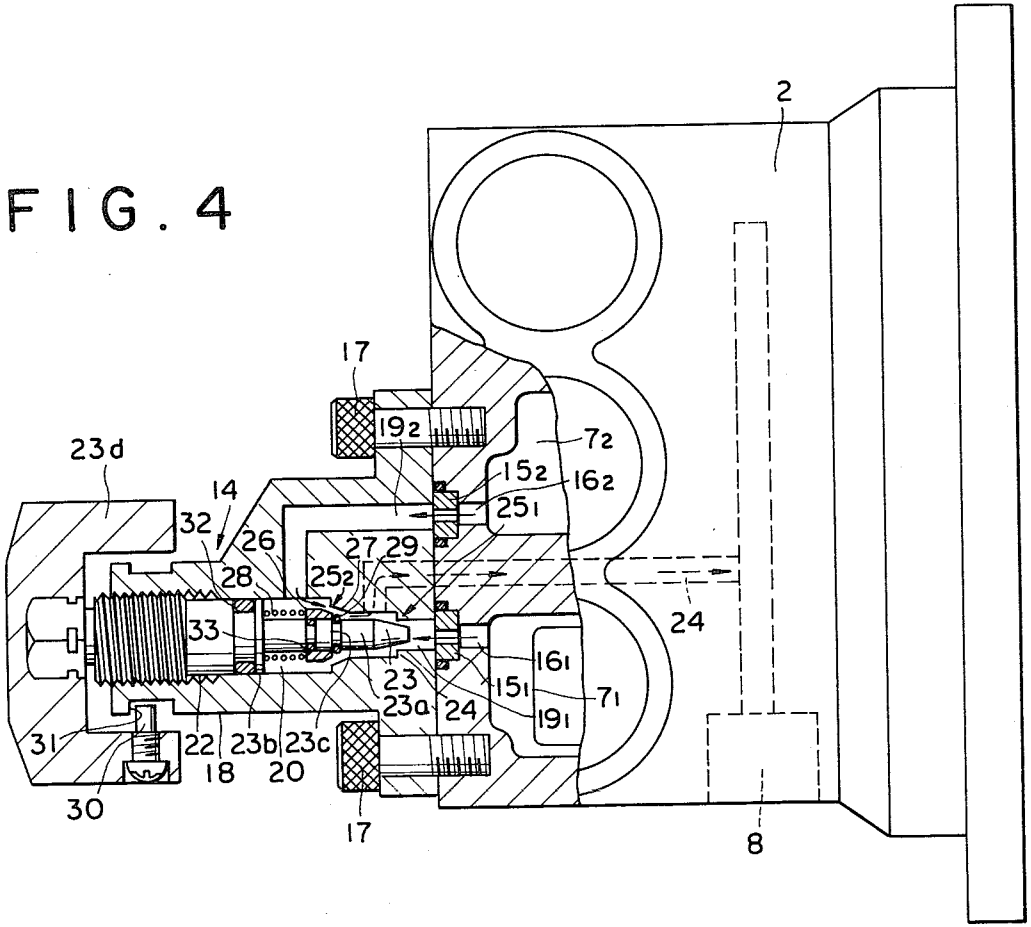

The reciprocating pump is shown in plan view in FIG. 2 wherein the first and second cylinders are denoted by reference numerals $7_1$ and $7_2$, respectively. To the discharge sides of these two cylinder $7_1$, $7_2$, there is mounted a flow rate control valve 14 of the present invention for enabling the flow rate of the fluid in the first and second cylinders $7_1$, $7_2$ to be adjusted in a manner to be described below. Thus, as shown in FIG. 2, on the discharge sides of the first and second cylinders $7_1$, $7_2$ are formed two passages $16_1$, $16_2$, in addition to the outlet ports as described with reference to FIG. 1, these passages having orifice ports $15_1$, $15_2$. A body member 18 of the flow control valve 14 is secured with screws 17 to the reciprocating pump 3 and has a first duct $19_1$ communicating with the passage $16_1$, a second duct $19_2$ communicating with the passage $16_2$, a double stepped cylinder chamber 20 communicating with these ducts $19_1$, $19_2$, and a bypass duct or passage 21 for communication between the stepped cylinder chamber 20 at back of a first step 24 and the suction port 8 of the reciprocating pump 3. The stepped cylinder chamber 20, arranged coaxially with the first duct $19_1$, has a female threaded passage 22 opening to the outside of the flow control valve. A valve needle 23 has a male threaded portion engaging with the female threaded passage 22 and is reciprocably introduced into the stepped cylinder chamber 20. The numeral $25_1$ denotes a first control zone where the valve needle 23 may be seated on a valve seat provided by the first step 24 of the cylinder chamber which is disposed between the first duct $19_1$ and the bypass passage 21. The numeral $25_2$ denotes a second control zone where a partly conical and partly cylindrical valving member 26 slidably fitted on a valve stem **23*a* of a needle valve 23 is seated on an inclined surface 27 ahead of a second step of the cylinder chamber 20 which is disposed between said second duct $19_2$ and the bypass passage 21. It is to be noted that the valving member 26 is always urged towards and into engagement with the valve seat 27 under the resilient force of a coil spring 28 placed under compression between the larger diameter end face of the valving member 26 and a flange 23*b* provided to the valve stem 23*a*. It is also to be noted that the lesser diameter end face of the valving member 26 may be engaged by a ring-like engaging projection 29, said projection being stationarily fitted into a peripheral groove 23*c* on the stem 23*a* slightly ahead of the inclined surface 27 and having its peripheral portion slightly projecting beyond the outer surface of the valve stem 23*a*, and that, when the needle valve 23 has been shifted out of contact with valve seat 24 by operation of a handle 23*d* secured to a root portion of the needle valve 23, the valving member 26 may be abutted by the projection 19 and thus shifted out of contact with the valve seat 27** with a certain time delay relative to the freeing of the first control zone.

The handle 23*d* is substantially U-shaped in cross-section and mounted so as to overlie a portion of the body member 18. The handle 23*d* has a pin 30 projecting inwardly from its recessed portion and engaging in a peripheral groove 31 on the body member, 18 to prevent incidental removal of the needle valve 23. A packing 32 is interposed between the needle valve 23 and the stepped cylinder chamber 20 to prevent fluid leakage to the outside. Similarly, a packing 33 is mounted in a sliding contact portion between the valve stem 23*a* of the needle valve 23 and the valving member 26 for assuring fluid tightness.

In operation of the inventive flow rate control valve of the present invention, when the handle 23*d* is manipulated for rotating the needle valve 23 for slightly separating the needle valve 23 away from the first step 24, the fluid contained in the first cylinder $7_1$ flows through passage $16_1$, orifice port $15_1$, first duct $19_1$ and the first control zone $25_1$ of the stepped cylinder chamber 20 its the bypass passage 21 to be returned to the suction port 8 of the pump. Thus, the flow and pressure of the fluid being delivered through the first cylinder $7_1$ may be adjusted as desired, thus resulting in a modified overall discharge flow rate from the pump. When desired to further modify the pump discharge flow rate, the handle 23*d* is further turned so that the needle valve 23 is moved further away from valve seat 24 and the engaging projection 29 abuts on the valving member 26 for disengaging the valving member from the inclined surface 27 against the force of coil spring 28. The fluid in the second cylinder $7_2$ may then flow through passage $16_2$, orifice port $15_2$, second duct $19_2$ and second control section $25_2$ of the stepped cylinder chamber 20 into the bypass passage 21 to be returned to the suction port 8 similarly to the fluid in the first cylinder $7_1$. Thus the fluid flow rate and pressure in the second cylinder $7_2$ may also be adjusted as desired, resulting in a further modified discharge flow rate from the pump. Thus, with the first and second control zones $25_1$, $25_2$ being opened for adjusting the discharge flow rate of the first and second cylinders $7_1$, $7_2$, the sum of the fluid flow rate through the third cylinder, not shown, and the fluid flow through the first and second cylinders less the fluid flow returned to the suction port 8 through the first and second control sections $25_1$, $25_2$, represents the total discharge flow rate from the pump.

From the forgoing it is seen that discharge flow rate from the multiple cylinder type reciprocating pump may be controlled by having the fluid in the two cylinders thereof fed back to the suction side so as to bypass the respective discharge valves. Since the fluid feedback operation for these two cylinders may be made simply by manipulating the handle of one and the same needle valve, the operation may be facilitated and the overall device may be made more compact in size. When the pump is used for feeding to a boiler, supply of cold water, warm water and steam may be realized by means of a single pump. Moreover, safety in steam production may be assured by pressure decrease caused by modified discharge flow rate. The present pump has great practical utility because of these and other advantages.

What is claimed is:

1. A flow rate control valve for a multiple cylinder type reciprocating pump, said control valve comprising, in combination, a body member of the control valve including a first duct communicating with a first passage on the discharge side of one cylinder, a second duct communicating with a second passage on the discharge side of another cylinder, said first and second passages being distinct from discharge ports for said cylinders, a double stepped cylinder chamber extending through the length of said body member with the forward opening end of the chamber defining said first duct, said cylinder chamber communicating with said second duct at back of a second rearward step, and a bypass passage communicating with said cylinder chamber at back of said first step and with a suction port of the pump; a needle valve extending into said cylinder chamber adjustably and reciprocably into a position normally abutting on said first step to interrupt fluid communication between said first duct and said bypass passage; and a valving member slidably fitted on said needle valve and spring-biased to normally abut on said second step to interrupt fluid communication between said second duct and said bypass passage; wherein said first step is first freed from the needle valve upon rearward displacement of said needle valve to establish fluid communication between said first duct and said bypass passage and thereafter said valving member is acted upon by a projection secured to said needle valve to free said second step from said valving member to establish fluid communication between said second duct and said bypass passage.

2. The control valve as claimed in claim 1 wherein said valving member is partly conical and partly cylindrical and normally spring-biased so that the conical face thereof abuts on a corresponding inclined surface of said second step.

3. The control valve as claimed in claim 1 wherein said needle valve is reciprocably movable by a handle fitted to the rear end of the body member of the control valve.

4. The control valve as claimed in claim 3 wherein a pin is projectedly mounted on a recessed side of said handle into a peripheral recess on said body member.

5. The control valve as claimed in claim 1 wherein said projection is a ring-like engaging projection stationatily fitted into a peripheral groove on the needle valve stem.

* * * * *